US012234820B2

(12) United States Patent
Guo et al.

(10) Patent No.: US 12,234,820 B2
(45) Date of Patent: Feb. 25, 2025

(54) ELECTRONIC OIL PUMP

(71) Applicant: ZHEJIANG SANHUA AUTOMOTIVE COMPONENTS CO., LTD., Zhejiang (CN)

(72) Inventors: Yao Guo, Zhejiang (CN); Lili Liu, Zhejiang (CN); Wei Ye, Zhejiang (CN); Fangxu Qian, Zhejiang (CN)

(73) Assignee: ZHEJIANG SANHUA AUTOMOTIVE COMPONENTS CO., LTD., Zhejiang (CN)

( * ) Notice: Subject to any disclaimer, the term of this patent is extended or adjusted under 35 U.S.C. 154(b) by 0 days.

(21) Appl. No.: 18/282,551

(22) PCT Filed: Mar. 18, 2022

(86) PCT No.: PCT/CN2022/081612
§ 371 (c)(1),
(2) Date: Sep. 18, 2023

(87) PCT Pub. No.: WO2022/194266
PCT Pub. Date: Sep. 22, 2022

(65) Prior Publication Data

US 2024/0183355 A1 Jun. 6, 2024

(30) Foreign Application Priority Data

Mar. 18, 2021 (CN) ..... 202110288188.4
Jul. 29, 2021 (CN) ..... 202110860993.X

(51) Int. Cl.
*F04C 2/10* (2006.01)
*F04C 15/00* (2006.01)

(52) U.S. Cl.
CPC ..... *F04C 15/00* (2013.01); *F04C 2/10* (2013.01); *F04C 2/102* (2013.01); *F04C 15/0088* (2013.01); *F04C 2210/206* (2013.01)

(58) Field of Classification Search
CPC .. F04C 2/10; F04C 2/102; F04C 15/00; F04C 15/0088; F04C 15/06; F04C 23/008;
(Continued)

(56) References Cited

U.S. PATENT DOCUMENTS 4,351,550 A 9/1982 Anderson et al.
5,036,822 A 8/1991 Kojima
(Continued)

FOREIGN PATENT DOCUMENTS

CN 102338005 A 2/2012
EP 3104010 B1 9/2019
(Continued)

OTHER PUBLICATIONS

JP018048609A—Matsuura et al.—Motor Pump—Mar. 29, 2018—the English Machine Translation. (Year: 2018).*
(Continued)

*Primary Examiner* — Theresa Trieu
(74) *Attorney, Agent, or Firm* — Yue (Robert) Xu; Apex Attorneys at Law, LLP

(57) ABSTRACT

An electronic oil pump, comprising a first housing and a first rotor assembly, the first housing having at least part of a first cavity, and the first rotor assembly being located in the first cavity. The electronic oil pump comprises a pump cover, the pump cover being fixedly connected with the first housing, and the pump cover at least partially covering the first rotor assembly. The electronic oil pump is provided with an inflow channel, the inflow channel being in communication with the first cavity. The electronic oil pump further comprises a filtering member, the filtering member being located upstream of the inflow channel or the filtering member being located at the inflow channel, and the filtering member being fixedly connected with the pump cover.

12 Claims, 8 Drawing Sheets

(58) Field of Classification Search
CPC .... F04C 29/0092; F04C 29/02; F04C 29/025; F04C 29/026; F04C 29/028; F04C 2210/206
See application file for complete search history.

(56) References Cited

U.S. PATENT DOCUMENTS

| | | | | |
|---|---|---|---|---|
| 5,578,221 | A | 11/1996 | Janik | |
| 5,908,020 | A | 6/1999 | Boutwell et al. | |
| 5,997,262 | A | 12/1999 | Finkbeiner et al. | |
| 6,039,551 | A | 3/2000 | Takeuchi et al. | |
| 6,189,513 | B1 | 2/2001 | Brown et al. | |
| 2016/0138587 | A1* | 5/2016 | Huang | F04C 15/008 417/410.4 |
| 2016/0303495 | A1* | 10/2016 | Suzuki | B29C 45/2628 |

FOREIGN PATENT DOCUMENTS

| | | | |
|---|---|---|---|
| GB | 1407522 | A | 9/1975 |
| IN | 208571776 | U | 3/2019 |
| JP | H08270575 | A | 10/1996 |
| JP | H09324781 | A | 12/1997 |
| JP | 2015-155187 | A | 8/2015 |
| JP | 2018-48609 | A | 3/2018 |
| JP | 2020-082049 | A | 6/2020 |

OTHER PUBLICATIONS

CN209671112U—Huang et al.—A Diesel Oil Filter With Integrated Controller For Electric Fuel Pump—Nov. 22, 2019—the English Machine Translation. (Year: 2019).*

JP2020082049A—Kawabata et al.—quality Reproduction Method and Applicant for Liquid and Preservation and Reuse Methods—the English Machine Translation. (Year: 2020).*

International Search Report for PCT/CN2022/081612 mailed Apr. 24, 2022, ISA/CN.

First Office Action dated Jul. 23, 2024 for Japanese patent application No. 2023-556748, English translation provided by Unitalen.

European Search Report issued on Dec. 17, 2024 for the European counterpart application No. 22770618.1.

* cited by examiner

ELECTRONIC OIL PUMP

This disclosure is a national phase application of PCT international patent application PCT/CN2022/081612, filed on Mar. 18, 2022 which claims the priority of the Chinese Patent Disclosure No. 202110860993.X, titled "ELECTRONIC OIL PUMP", filed on Jul. 29, 2021 with the China National Intellectual Property Administration and the priority of the Chinese Patent Disclosure No. 202110288188.4, titled "ELECTRONIC OIL PUMP", filed on Mar. 18, 2021 with the China National Intellectual Property Administration, which are incorporated herein by reference in their entireties.

FIELD

The present disclosure relates to the technical field of vehicles, and in particular to an assembly of a lubrication system and/or a cooling system of a vehicle.

BACKGROUND

An electronic oil pump mainly provides power source for a lubrication system and/or a cooling system of a vehicle, and its internal structure usually includes a rotor assembly. During the operation of the electronic oil pump, impurities may accumulate on the rotor assembly and thus affect the working performance of the electronic oil pump. Therefore, how to reduce the influence of impurities on the performance of the electronic oil pump is a problem that needs to be considered in the design process.

SUMMARY

An electronic oil pump is provided according to the present disclosure, which is conducive to reducing the influence of impurities on the performance of the electronic oil pump.

In order to achieve the above object, the following technical solution is provided according to an embodiment of the present disclosure:

An electronic oil pump includes a first housing and a first rotor assembly, where the first housing has at least a part of a first cavity, and the first rotor assembly is located in the first cavity. The electronic oil pump includes a pump cover, which is fixedly connected with the first housing and at least partially covers the first rotor assembly. The electronic oil pump has an inflow channel, which is in communication with the first cavity. The electronic oil pump further includes a filtering member, which is located at the upstream of the inflow channel or is located at the inflow channel, and the filtering member is fixedly connected with the pump cover or limitedly provided relative to the pump cover.

By the above way, the filtering member can filter impurities of working medium flowing into the first cavity, which is conducive to reducing the impurities to enter the first cavity, and since the first rotor assembly is located in the first cavity, this is beneficial to prevent the impurities from affecting the rotation of the first rotor assembly, and to prevent the first rotor assembly from not operating normally due to the accumulation of impurities, which is in turn conducive to reducing the influence of impurities on the performance of the electronic oil pump.

DETAILED DESCRIPTION OF THE EMBODIMENTS

The present disclosure will be further described as follows in conjunction with the drawings and specific embodiments.

The electronic oil pump in the following embodiments mainly provide fluid power for working medium of a lubrication system and/or cooling system of a vehicle, and specifically provide fluid power for the working medium of the lubrication system and/or cooling system in a transmission system of the vehicle.

Figure 1:
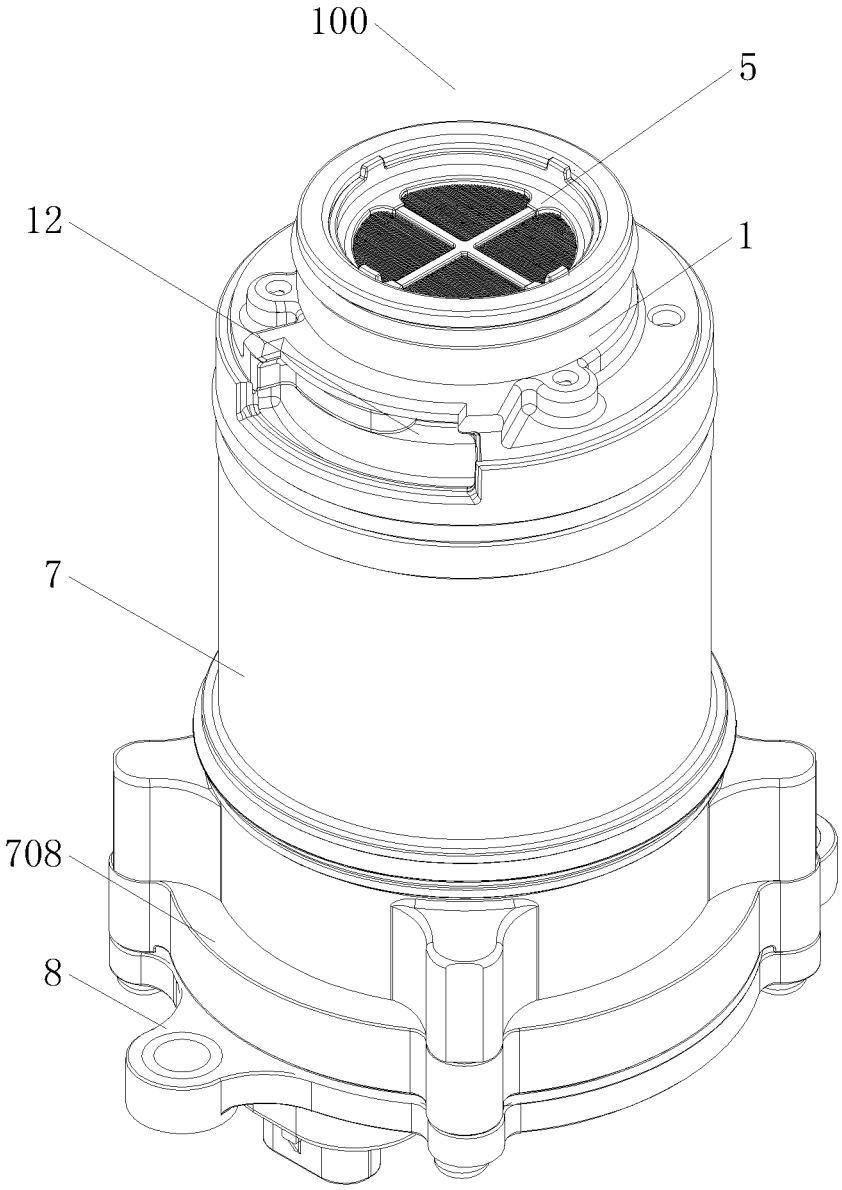
FIG. 1 is a schematic perspective structural view of an embodiment of an electronic oil pump according to the present disclosure.
Figure 2:
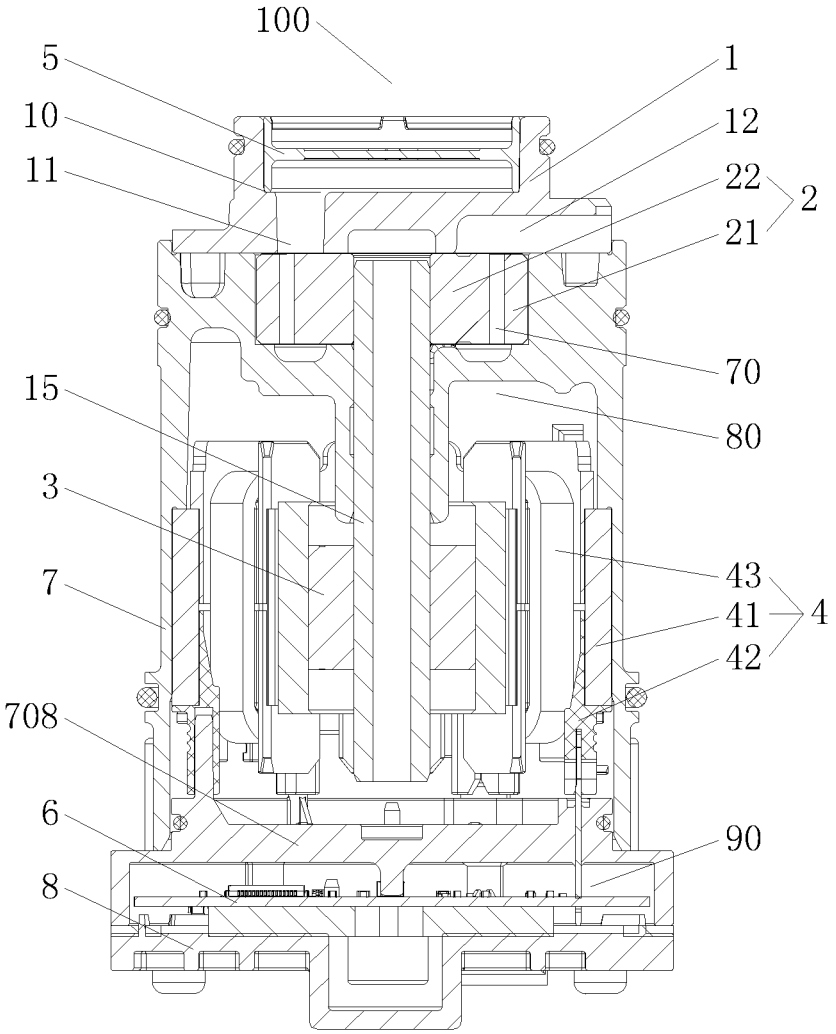
FIG. 2 is a schematic cross-sectional structural view of an first embodiment of the electronic oil pump shown in FIG. 1.

With reference to FIG. 1 and FIG. 2, an electronic oil pump 100 includes a pump housing, a first rotor assembly 2, a second rotor assembly 3, a stator assembly 4 and a circuit board assembly 6. The pump housing can form a pump cavity, and the first rotor assembly 2, the second rotor assembly 3, the stator assembly 4 and the circuit board assembly 6 are arranged in the pump cavity. In this embodiment, the pump chamber includes a first chamber 70, a second chamber 80 and a third chamber 90, where the first rotor assembly 2 is located in the first chamber 70, the second rotor assembly 3 and the stator assembly 4 are located in the second chamber 80, and the circuit board assembly 6 is located in the third chamber 90. The first chamber 70 is in communication with the second chamber 80, and the second chamber 80 is not in communication with the third chamber 90. The electronic oil pump 100 further has an inflow channel 11, which is in communication with the first chamber 70. Working medium can first enter the first chamber 70 through the inflow channel 11 and then enter the second chamber 80 from the first chamber 70, so that the first rotor assembly 2, the second rotor assembly 3 and the stator assembly 4 can work normally.

Specifically, the pump housing includes a pump cover 1, a first housing 7 and a second housing 8. In a height direction of the electronic oil pump 100, the pump cover 1 is partially located above the first housing 7, and the first housing 7 is partially located between the pump cover 1 and the second housing 8. In this embodiment, the inflow channel 11 is formed in the pump cover 1, and the first chamber 70 and the second chamber 80 are formed in the first housing 7. Of course, in other embodiments, the first chamber 70 and the second chamber 80 may also be partially formed in the first housing 7. Therefore, in the height direction of the electronic oil pump 100, the inflow channel 11 is located above the first chamber 70, the first chamber 70 is located above the second chamber 80, and the first rotor assembly 2 is located in the first chamber 70, so that the pump cover 1 can cover the first rotor assembly 2. Of course, in other embodiments, the pump cover 1 may only partially cover the first rotor assembly 2. The electronic oil pump 100 further includes a partition member 708. In the height direction of the electronic oil pump 100, the partition member 708 is partially located between the first housing 7 and the second housing 8, the second rotor assembly 3 and the stator assembly 4 are located on one side of the partition member 708, and the circuit board assembly 6 is located on the other side of the partition member 708. The chamber formed between the partition member 708 and the second housing 8 includes a third chamber 90, as shown in FIG. 2. A sealing structure is provided between the partition member 708 and the pump housing, so that the working medium in the second chamber 80 cannot flow to the third chamber 90 through the partition member 708, which is beneficial to prevent the working medium from entering the side where the circuit board assembly 6 is located, thus preventing the working medium from affecting the performance of the circuit board assembly 6 and affecting the performance of the electronic oil pump.

With reference to FIG. 1 and FIG. 2, the pump cover 1 is fixedly connected with the first housing 7. Specifically, in this embodiment, the pump cover 1 is fixedly connected with the first housing 7 by screws or bolts, which facilitates the disassembly and assembly of the electronic oil pump, thus facilitating the maintenance of the first rotor assembly 2. Of course, the pump cover 6 and the first casing 7 may also be connected in other ways, such as plugging and snap-fitting, etc. The first housing 7 is connected with the second housing 8 by screws or bolts. Specifically, in this embodiment, a part of the partition member 708 is fixed between the first housing 7 and the second housing 8, and the screws or bolts pass through the first housing 7, the partition member 708 and the second housing 8 in turn, so that the first housing 7 and the second housing 8 are indirectly and fixedly connected with each other, as shown in FIG. 1. Of course, in other embodiments, the first housing 7 and the second housing 8 may also be directly and fixedly connected by screws or bolts, and in that case, the structure of the partition member 708 will be changed accordingly. For example, but not limited to, the partition member 708 can be positioned and fixed by tightly fitting with an inner peripheral wall of the first housing 7. The connection of the first housing 7 and the second housing 8 by screws or bolts facilitates the disassembly and assembly of the electronic oil pump. In this embodiment, since the circuit board assembly 6 is located in the chamber between the partition member 708 and the second housing 8, it is also conducive to the maintenance of the circuit board assembly 6 in the electronic oil pump. Moreover, it can make the connection between the first housing 7 and the second housing 8 more reliable.

Figure 3:
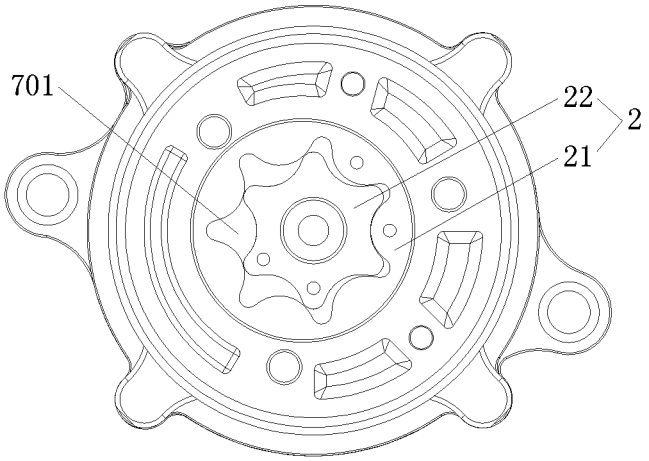
FIG. 3 is a schematic top structural view of the electronic oil pump shown in FIG. 1 with a pump cover removed.

With reference to FIG. 2 and FIG. 3, the first rotor assembly 2 includes a first rotor 21 and a second rotor 22. The first rotor assembly 21 includes a plurality of internal teeth and the second rotor assembly 22 includes a plurality of external teeth. A hydraulic chamber 701 is provided between the internal teeth of the first rotor assembly 21 and the external teeth of the second rotor assembly 22. In this embodiment, the hydraulic chamber 701 is also a part of the first chamber 70, and the first rotor 21 is sleeved outside an outer periphery of the second rotor 22. The electronic oil pump 100 further includes an outflow channel 12, where the working medium can enter the hydraulic chamber 701 through the inflow channel 11 and leave the hydraulic chamber 701 through the outflow channel 12. Because there is a certain eccentricity between the first rotor 21 and the second rotor 22, when the second rotor 22 rotates, some of the external teeth of the second rotor 22 mesh with some of the internal teeth of the first rotor 21, thus driving the first rotor 21 to rotate. In the process of one revolution of the first rotor 21 and the second rotor 22, the volume of the hydraulic chamber 701 changes. Specifically, when the first rotor assembly 2 rotates to a certain angle from the beginning, the volume in the hydraulic chamber 701 gradually increases, thus forming a partial vacuum, and then the working medium is sucked into the hydraulic chamber 701 from the inflow channel 11. When the first rotor 21 and the second rotor 22 continue to rotate, the volume of the hydraulic chamber 701 filled with the working medium gradually decreases, and the working medium is squeezed, so that the working medium entering the hydraulic chamber 701 is pushed out to the outflow channel 12, thereby generating fluid power.

With reference to FIG. 2, the stator assembly 4 includes a stator core 41, an insulating frame 42 and a winding 43, where the insulating frame 42 covers at least part of the surface of the stator core 41, and the winding 43 is wound around the insulating frame 42. The circuit board assembly 6 has a control function. During the operation of the electronic oil pump 100, the circuit board assembly 6 controls the current in the winding 43 passing through the stator assembly 4 to change according to a predetermined rule, thereby controlling the stator assembly 4 to generate a changing excitation magnetic field. The second rotor assembly 3 has magnetic poles and rotates under the action of the excitation magnetic field, and the second rotor assembly 3 can directly or indirectly drive the first rotor assembly 2 to rotate. Specifically, in this embodiment, the electronic oil pump 100 further includes a pump shaft 15, which is fixedly or limitedly connected with the second rotor assembly 3. The pump shaft 15 can rotate with the second rotor assembly 3, drive part of the first rotor assembly 2 to rotate, and specifically, drive the second rotor 22 to rotate. In an axial direction of the pump shaft 15, one end of the pump shaft 15 is connected with the second rotor 22, and the opposite end of the pump shaft 15 is connected with the second rotor assembly 3. The second rotor assembly 3 drives the second rotor 22 to rotate by the pump shaft 15, thus realizing the rotation of the first rotor assembly 2. In this embodiment, at least part of the working medium in the first chamber 70 can flow into the second chamber 80. As the stator assembly 4 is located in the second chamber 80, the working medium in the second chamber 80 can cool the stator assembly 4, which is beneficial to the heat dissipation of the stator assembly 4.

Figure 4:
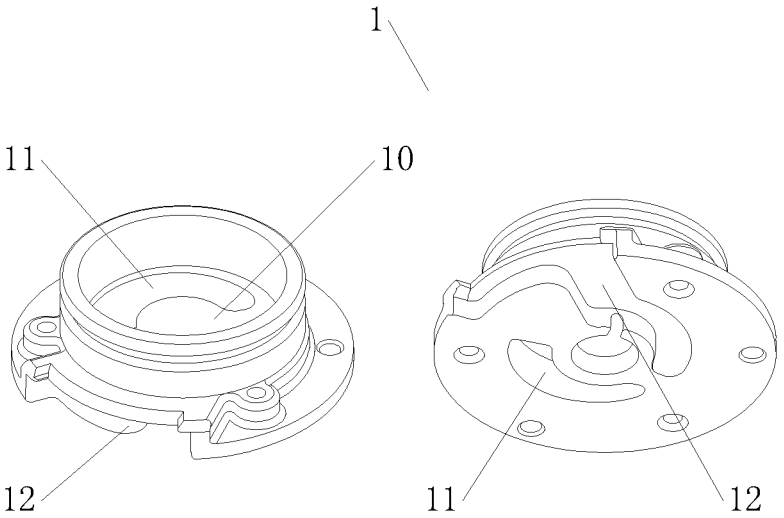
FIG. 4 is a schematic perspective structural view of the pump cover from two different perspectives.
Figure 5:
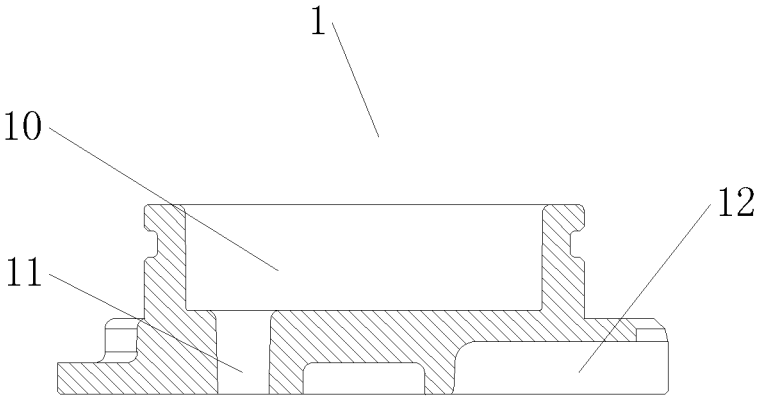
FIG. 5 is a schematic cross-sectional structural view of the pump cover shown in FIG. 4.

With reference to FIG. 4 and FIG. 5, the pump cover 1 has an accommodating chamber 10. In this embodiment, the inflow channel 11 and the outflow channel 12 are both formed in the pump cover 1. The accommodating chamber 10 is located above the inflow channel 11, and the accommodating chamber 10 communicates the outside of the electronic oil pump with the inflow channel 11, and the inflow channel 11 communicates the accommodating chamber 10 with the first chamber 70. Specifically, in the height direction of the electronic oil pump, the accommodating chamber 10 has an opening on upper wall of the pump cover 1, and the accommodating chamber 10 is recessed relative to the upper wall of the pump cover 1. The inflow channel 11 is formed in shape of through hole, where in the height direction of the electronic oil pump, one end of the inflow channel 11 has an opening on bottom wall of the accommodating chamber 10, and the other end of the inflow channel 11 has an opening on lower wall of the pump cover 1. The outflow channel 12 does not penetrate though the pump cover 1, and is recessed relative to the lower wall and side wall of the pump cover 1. The inflow channel 11 is located between the accommodating chamber 10 and the first chamber 70, and communicates the accommodating chamber 10 with the first chamber 70, so that the accommodating chamber 10 is located upstream of the inflow channel 11, and the working medium entering the electronic oil pump 100 can first enter the electronic oil pump 100 through the accommodating chamber 10, and then part of the working medium enters the first chamber 70 through the inlet channel 11, and then part of the working medium flows out of the first chamber 70 through the outlet channel 12.

With reference to FIG. 2, the electronic oil pump 100 includes a filtering member 5, which can filter the impurities in the fluid. In this embodiment, the filtering member 5 is fixedly connected with the pump cover 1 or limitedly provided relative to the pump cover 1, and in the height direction of the electronic oil pump, the filtering member 5 is located upstream of the inflow channel 11 so that the working medium entering the inflow channel 11 can first be filtered by the filtering member 5, and then enter the first chamber 70 of the electronic oil pump through the inflow channel 11. This is beneficial to reduce impurities in the working medium to flow into the first chamber 70, affecting the operation of the first rotor assembly 2. In addition, since the first chamber 70 is in communication with the second chamber 80, it is also beneficial to reduce impurities in the working medium to enter the second chamber 80, thus affecting the operation of the second rotor assembly 3, so that the working performance of the electronic oil pump 100 can be improved. Of course, the filtering member may also be arranged in the inflow channel, and the filtering member is fixedly connected with the wall forming the inflow channel, which can also reduce impurities in the working medium to enter the second chamber 80, thus affecting the operation of the second rotor assembly 3, so that the working performance of the electronic oil pump 100 can be improved.

Figure 6:
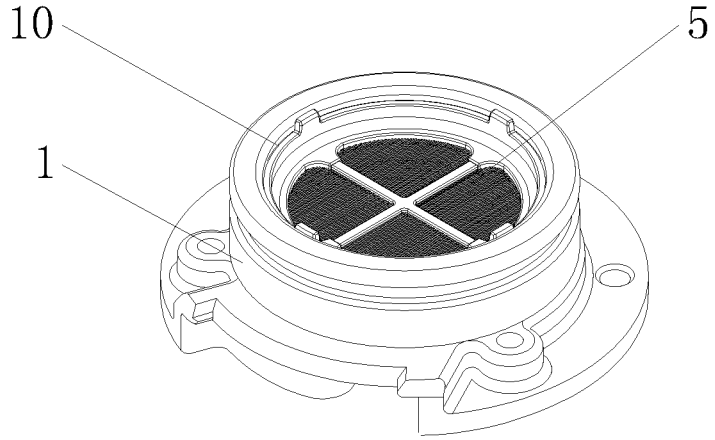
FIG. 6 is a schematic perspective structural view of the cooperation of a filtering member with a pump cover.
Figure 7:
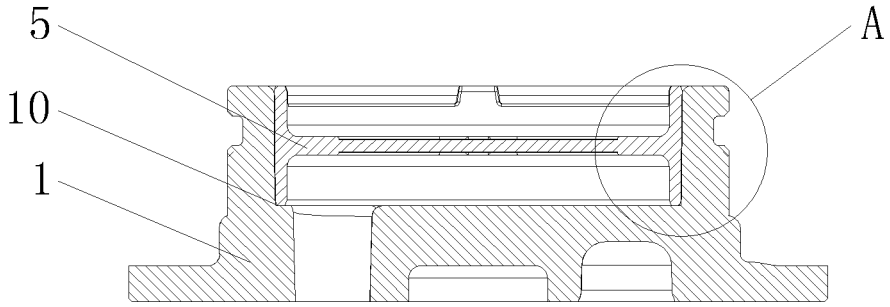
FIG. 7 is a schematic cross-sectional structural view of the cooperation of the filtering member fitted with the pump cover.

With reference to FIG. 6 and FIG. 7, in this embodiment, the filtering member 5 is located in the accommodating chamber 10 of the pump cover 1, and the filtering member 5 is fitted and limitedly connected with corresponding inner peripheral wall of the accommodating chamber 10, so that the filtering member 5 is relatively fixed to the pump cover 1. Of course, in other embodiments, the filtering member 5 may only be partially arranged in the accommodating chamber 10 of the pump cover 1, and part of the outer peripheral wall of the filtering member 5 is fitted with part of the corresponding inner peripheral wall of the accommodating chamber 10, which will not be described in detail here. Because the accommodating chamber 10 is located upstream of the inflow channel 11, the working medium will pass through the accommodating chamber 10 before passing through the inflow channel 11, so that the filtering member 5 located in the accommodating chamber 10 can filter the impurities in the working medium, which is beneficial to reducing the impurities in the working medium passing through the accommodating chamber 10 to enter the inflow channel 11 and then enter the first chamber 70, thus the influence on the operation of the first rotor assembly 2 located in the first chamber 70 can be improved.

Figure 8:
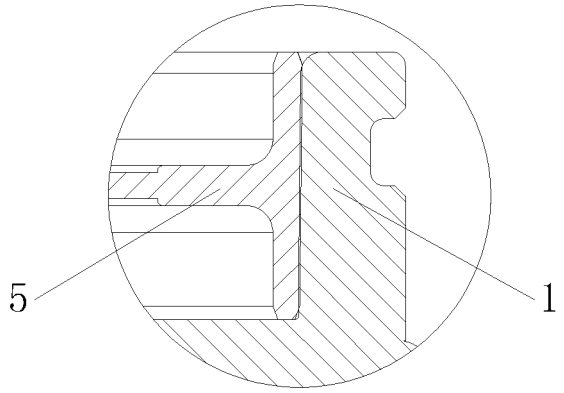
FIG. 8 is an enlarged schematic view of a partial structure of a first embodiment of part A in FIG. 7.

With reference to FIG. 8, in one embodiment, the filtering member 5 is connected with the pump cover 1 by interference fit or transition fit. Specifically, the outer peripheral wall of the filtering member 5 is tightly fitted with the inner peripheral wall of the accommodating chamber 10, where "tightly fitted" means that the tight connection thereof is realized by interference fit or transition fit. Of course, in other embodiments, it is also possible that the outer peripheral wall of the filtering member 5 is partially tightly-fitted with part of the inner peripheral wall of the accommodating chamber 10, which will not be described in detail here.

Figure 9:
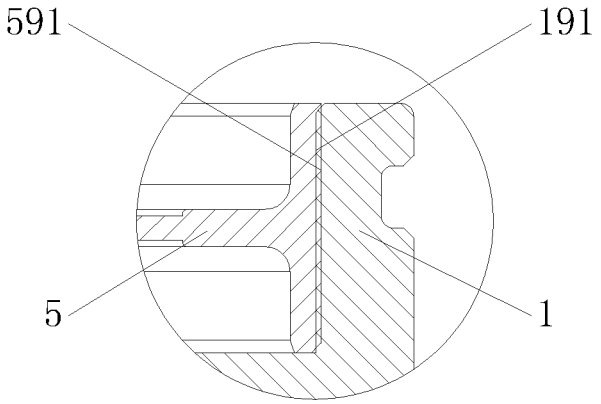
FIG. 9 is an enlarged schematic view of a partial structure of a second embodiment of part A in FIG. 7.

With reference to FIG. 9, in other embodiments, the filtering member 5 is fixedly connected with the pump cover 1 in threaded fitting way. Specifically, the outer peripheral wall of the filtering member 5 has external threads 591, and the corresponding inner peripheral wall of the accommodating chamber 10 has internal threads 191. Under the threaded fit of the external threads 591 and the internal threads 191, the filtering member 5 is fixedly connected with the pump cover 1.

Figure 10:
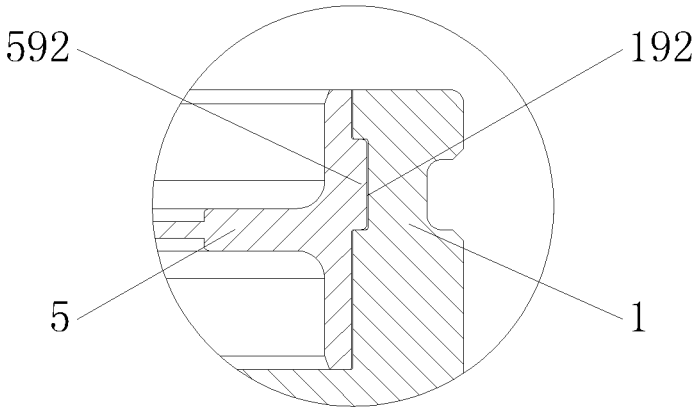
FIG. 10 is an enlarged schematic view of a partial structure of a third embodiment of part A in FIG. 7.

With reference to FIG. 10, in other embodiments, the filtering member 5 is fixedly connected with the pump cover 1 in a snap-fitting way. Specifically, the filtering member 5 includes a first convex portion 592, and the pump cover 1 has a first concave portion 192, where the first convex portion 592 is formed on the outer peripheral wall of the filtering member 5 and protrudes relative to the outer peripheral wall of the filtering member 5, while the first concave portion 192 is formed on the corresponding inner peripheral wall of the accommodating chamber 10 and recessed relative to the corresponding inner peripheral wall of the accommodating chamber 10. The first convex portion 592 is located in the chamber of the first concave portion 192, and the first convex portion 592 is snap fitted with the first concave portion 192, so that the filtering member 5 is fixedly connected with the pump cover 1. In this embodiment, the first convex portions 592 are arranged to be distributed discretely along the outer peripheral wall of the filtering member 5, and the first concave portions 192 are arranged to be distributed discretely along the inner peripheral wall of the accommodating chamber 10. Of course, in other embodiments, the first convex portions 592 and the first concave portions 192 can also be distributed continuously along their respective peripheral walls, which will not be described in detail here.

Figure 11:
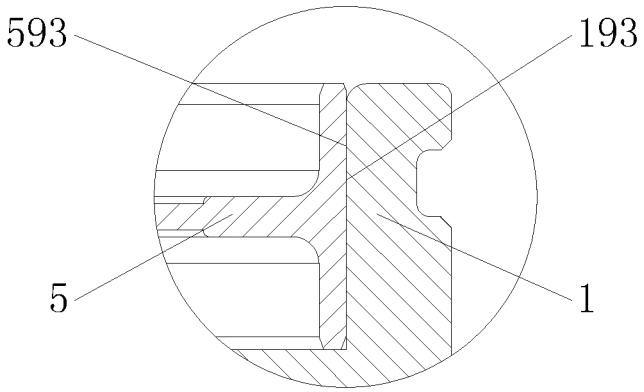
FIG. 11 is an enlarged schematic view of a partial structure of a fourth embodiment of part A in FIG. 7.

With reference to FIG. 11, in other embodiments, the filtering member 5 is fixedly connected with the pump cover 1 by a thermal melting way. Specifically, the pump cover 1 is made of nonmetallic material, and the corresponding material of the part, used for connecting with the pump cover 1, of the filtering member 5 is also nonmetallic material. The outer peripheral wall of the filtering member 5 has a first mating surface 593, and the corresponding inner peripheral wall of the accommodating chamber 10 has a second mating surface 193. The first mating surface 593 and the second mating surface 193 are heated to a molten state, and then the first mating surface 593 and the second mating surface 193 are fitted together and cooled, so that the outer peripheral wall of the filter element 5 and the corresponding inner peripheral wall of the accommodating chamber 10 are connected as a whole and thus a hot melting connection is achieved, so that the filter element 5 is fixedly connected with the pump cover 1.

Figure 12:
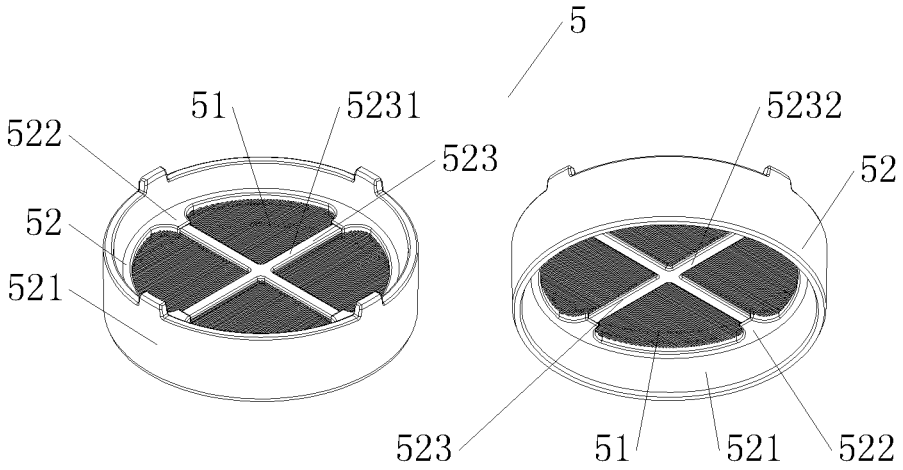
FIG. 12 is a schematic perspective structural view of a first embodiment of a filtering member.
Figure 13:
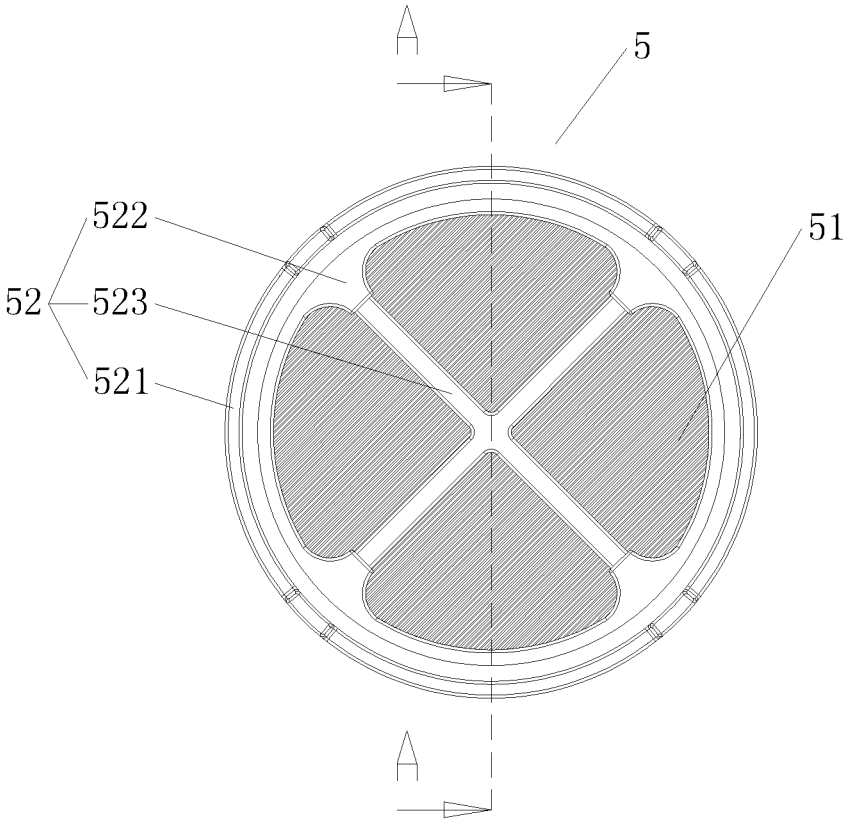
FIG. 13 is a schematic top structural view of the first embodiment of the filtering member.
Figure 14:
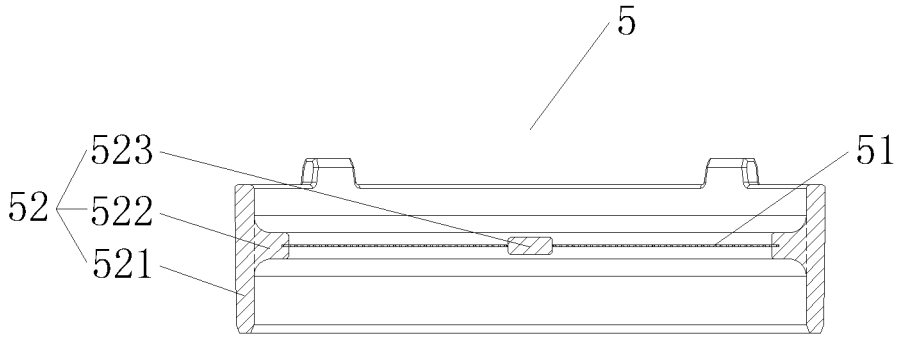
FIG. 14 is a schematic cross-sectional structural view of the filtering member taken along the A-A direction in FIG. 13.

With reference to FIG. 12, FIG. 13 and FIG. 14, the filtering member 5 includes a filter part 51 and a support part 52. In this embodiment, the filter part 51 is a filter screen for filtering impurities in the working medium, and the support part 52 is an injection molded part. In this embodiment, the support part 52 is formed by injection molding with the filter part 51 made of a filter screen as an insert, and the outer peripheral wall of the support part 52 constitutes the outer peripheral wall of the filtering member 5. Of course, in other embodiments, it is also possible that part of the support part 52 is formed by injection molding with the filter part 51 in form of filter screen as an insert, and the support part 52 may include a non-injection molding part. Similarly, it is also possible that only part of the outer peripheral wall of the support part 52 constitutes the outer peripheral wall of the filtering member 5, which will not be described in detail here. In this embodiment, the support part 52 is used for fixing and supporting the filter screen on the one hand and connecting the pump cover 1 on the other hand. Due to the existence of the support part 52, it facilitates of fixing the filtering member 5 in the accommodating chamber 10.

Figure 15:
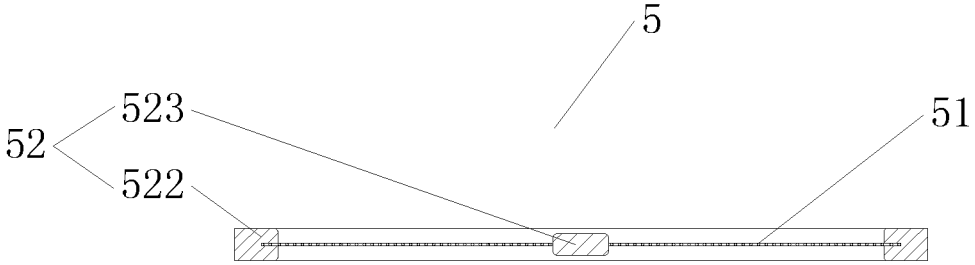
FIG. 15 is a schematic cross-sectional structural view of a second embodiment of a filtering member.

With reference to FIG. 12, FIG. 13 and FIG. 14, specifically, in this embodiment, the support part 52 includes a main body portion 521 and a connecting portion 522 located at the inner periphery of the main body portion 521. The main body portion 521 and the connecting portion 522 are connected as a whole, and the connecting portion 522 is continuously distributed along the inner peripheral wall of the main body portion 521. In this embodiment, the height of the main body portion 521 is greater than that of the connecting portion 522, and the outer peripheral wall of the main body portion 521 constitutes the outer peripheral wall of the filtering member 5, which is beneficial to increase the area of the outer peripheral wall of the filtering member 5, and further to increase the fitting area of the filtering member 5 with the corresponding inner peripheral wall of the accommodating chamber 10, thus making the fixed connection between the filtering member 5 and the accommodating chamber 10 more stable. With reference to FIG. 12 and FIG. 13, a lower end of the main body portion 521 abuts against the bottom wall of the accommodating chamber 10, which facilitates the positioning of the filter 5 in the height direction during the fitting process. In this embodiment, the connecting portion 522 is arranged around the filter part 51, or part of the connecting portion 522 is arranged around the filter part 51. It can also be understood that the connecting portion 522 is continuously distributed along the circumferential direction of the filter part 51, and the filter part 51 is partially embedded in the connecting portion 522, so that the filter part 51 is fixedly connected with the connecting portion 522, as shown in FIG. 14. Of course, in other embodiments, the supporting part 52 may not include the main body portion 521, and the outer peripheral wall of the connecting portion 522 constitutes the outer peripheral wall of the filtering member 5, as shown in FIG. 15, which is beneficial to reducing the structural weight of the filtering member 5. As shown in FIG. 14, the dotted line in the figure is an intended division of the main body portion 521 and the connecting portion 522, and is intended to make the structural relationship between the main body portion 521 and the connecting portion 522 understandable.

With reference to FIG. 12, FIG. 13 and FIG. 14, in this embodiment, the supporting part 52 further includes a reinforcing rib 523, which is located at the inner periphery of the connecting portion 522. The reinforcing rib has two end portions, and each end portions of the reinforcing rib 523 is integrally connected with the inner peripheral wall of the connecting portion 522 by injection molding, so that the reinforcing rib 523 can perform the function of supporting at the inner periphery of the connecting portion 522, which is beneficial to improving the overall structural strength of the support part 52 as the injection-molded part. In this embodiment, the upper surface and the lower surface of the filter part 51 each is supported with a reinforcing rib 523, where the reinforcing rib on one surface is defined as first reinforcing rib 5231, and the reinforcing rib on the other surface is defined as second reinforcing rib 5232, that is, in the height direction of the electronic oil pump, the first reinforcing rib 5231 and the second reinforcing rib 5232 are located on the upper side and lower side of the filter part 51, respectively, as shown in 30) FIG. 12. In this embodiment, the reinforcing ribs 523 include two crossed first reinforcing ribs 5231 and two crossed second reinforcing ribs 5232. Of course, in other embodiments, the reinforcing ribs 523 may be supported on one of the upper surface and the lower surface of the filter part 551. Here, it should be understood that the structural form and number of the reinforcing ribs 523 can be varied. In this embodiment, the arrangement of the reinforcing ribs is beneficial to improve the structural stability of the filter part 51, so that the filter part 51 is not easy to fall off due to the impact of the working medium during the filtering process.

Technical features of the foregoing embodiments may be combined freely. For conciseness of description, all possible combinations of the technical features of the foregoing embodiments are not described. However, as long as there is no contradiction in the combinations of these technical features, they shall fall within the scope of this specification.

The above-mentioned embodiments are only used to illustrate the present application, but not to limit the technical solutions described by the present application. Although the present application is described in detail hereinabove with reference to the above embodiments, those of ordinary skill in the art should understand that modification or equivalent replacement may be made to the present application, and all technical solutions and improvements thereof that do not depart from the spirit and scope of the present application should be covered by the scope of the claims of the present application.

The invention claimed is:

1. An electronic oil pump, comprising a first housing and a first rotor assembly, wherein the first housing has at least a part of a first cavity, and the first rotor assembly is located in the first cavity; the electronic oil pump comprises a pump cover, which is fixedly connected with the first housing and at least partially covers the first rotor assembly, wherein the electronic oil pump has an inflow channel, which is in communication with the first cavity;

wherein the electronic oil pump further comprises a filtering member, which is located at the upstream of the inflow channel or is located at the inflow channel, and the filtering member is fixedly connected with the pump cover or limitedly provided relative to the pump cover, wherein the filtering member comprises a filter part and a support part, the filter part is a filter screen, and the support part is an injection molded part and is at least formed by injection molding with the filter part as an insert; and wherein an outer peripheral wall of the filtering member includes at least part of an outer peripheral wall of the support part, wherein the support part comprises a reinforcing rib and a connecting portion, the reinforcing rib is located at an inner periphery of the connecting portion and has two end portions, the two end portions of the reinforcing rib each is integrally connected with the inner peripheral wall of the connecting portion, an outer peripheral wall of the connecting portion constitutes the outer peripheral wall of the filtering member; and wherein at least one of the upper surface and the lower surface of the filter part are supported with the reinforcing rib.

2. The electronic oil pump according to claim 1, wherein the pump cover is at least formed by injection molding with the filtering member as an insert.

3. The electronic oil pump according to claim 2, wherein the pump cover has an accommodating chamber with an opening on an upper wall of the pump cover, and in a height direction of the electronic oil pump, the accommodating chamber is recessed relative to the upper wall of the pump cover; and wherein the inflow channel, communicating the accommodating chamber with the first cavity, is formed on the pump cover, and the filtering member is at least partially located in the accommodating cavity.

4. The electronic oil pump according to claim 3, wherein at least part of outer peripheral wall of the filtering member is fitted and limitedly connected with at least part of corresponding inner peripheral wall of the accommodating cavity.

5. The electronic oil pump according to claim 4, wherein at least part of the outer peripheral wall of the filtering member is connected with at least part of the inner peripheral wall of the accommodating chamber by interference fit or transition fit, so that the filtering member is fixedly connected with the pump cover.

6. The electronic oil pump according to claim 1, wherein the pump cover has an accommodating chamber with an opening on an upper wall of the pump cover, and in a height direction of the electronic oil pump, the accommodating chamber is recessed relative to the upper wall of the pump cover; and wherein the inflow channel, communicating the accommodating chamber with the first cavity, is formed on the pump cover, and the filtering member is at least partially located in the accommodating cavity.

7. The electronic oil pump according to claim 6, wherein at least part of outer peripheral wall of the filtering member is fitted and limitedly connected with at least part of corresponding inner peripheral wall of the accommodating cavity.

8. The electronic oil pump according to claim 7, wherein at least part of the outer peripheral wall of the filtering member is connected with at least part of the inner peripheral wall of the accommodating chamber by interference fit or transition fit, so that the filtering member is fixedly connected with the pump cover.

9. The electronic oil pump according to claim 7, wherein the outer peripheral wall of the filtering member has external threads, and the corresponding inner peripheral wall of the accommodating chamber has internal threads; and wherein the filtering member is fixedly connected with the pump cover by the threaded fit of the external threads and the internal threads.

10. The electronic oil pump according to claim 7, wherein the filtering member comprises a first convex portion which protrudes relative to the outer peripheral wall of the filtering member and is continuously or discretely distributed along the outer peripheral wall of the filtering member; and the pump cover has a first concave portion which is recessed relative to the corresponding inner peripheral wall of the accommodating chamber and is continuously or discretely distributed along the corresponding inner peripheral wall of the accommodating cavity; and wherein at least part of the first convex portion is located in a chamber of the first concave portion, and the first convex portion is tightly fitted with the first concave portion so that the filtering member is connected with the pump cover.

11. The electronic oil pump according to claim 7, wherein a material of the pump cover comprises a nonmetallic material, and a corresponding material of a part, used for connecting with the pump cover, of the filtering member comprises a nonmetallic material; and wherein at least part of the outer peripheral wall of the filtering member is connected with at least part of the corresponding inner peripheral wall of the accommodating chamber by hot melting.

12. The electronic oil pump according to claim 1, wherein the support part comprises a main body portion, wherein the connecting portion is located at an inner periphery of the main body portion, and is connected with the main body portion as a whole, and is continuously distributed along the inner peripheral wall of the main body portion; and wherein at least part of the connecting portion is arranged around the filter part, and part of the filter part is embedded in the connecting portion.

* * * * *